US006220067B1

(12) United States Patent
Sano

(10) Patent No.: US 6,220,067 B1
(45) Date of Patent: Apr. 24, 2001

(54) ROLLED MATERIAL TEMPERATURE CONTROL METHOD AND ROLLED MATERIAL TEMPERATURE CONTROL EQUIPMENT OF DELIVERY SIDE OF ROLLING MILL

(75) Inventor: Mitsuhiko Sano, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/489,021

(22) Filed: Jan. 21, 2000

(30) Foreign Application Priority Data

Jan. 21, 1999 (JP) ..... 11-013357

(51) Int. Cl.[7] ..... B21B 37/74

(52) U.S. Cl. ..... 72/8.5; 72/11.3; 72/12.2; 72/2.1

(58) Field of Search ..... 72/8.5, 12.2, 201, 72/11.3, 200

(56) References Cited

U.S. PATENT DOCUMENTS

| | | | | |
|---|---|---|---|---|
| 3,604,234 | * | 9/1971 | Hinrichsen et al. | 72/12.2 |
| 4,274,273 | * | 6/1981 | Fapiano et al. | 72/8.5 |
| 4,745,786 | * | 5/1988 | Wakako et al. | 72/12.2 |
| 4,785,646 | * | 11/1988 | Uekaji et al. | 72/8.5 |
| 5,724,842 | * | 3/1998 | Beattie et al. | 72/12.2 |

FOREIGN PATENT DOCUMENTS

| | | | | |
|---|---|---|---|---|
| 2-169120 | * | 9/1990 | (JP) | 72/8.5 |
| 7-075816 | | 3/1995 | (JP) . | |
| 8-150409 | | 6/1996 | (JP) . | |
| 10-094814 | | 4/1998 | (JP) . | |

* cited by examiner

*Primary Examiner*—Ed Tolan
(74) *Attorney, Agent, or Firm*—Foley & Lardner

(57) ABSTRACT

Inter-rolling stand cooling devices are provided. When determining rolling speed and cooling water flows based upon the material temperature measured further upstream than the rolling mill, material positions detected by sensors on the mill line and information pre-determined in accordance with the production plan that includes material Steel Grade, rolling mill entry side material thickness, product strip thickness target value and rolling mill delivery side temperature target value, the positions in the longitudinal direction of multiple calculation points on the material are calculated based upon initial information, the heat generation and heat loss occurring at each rolling stand are calculated at every calculation point based upon the initial information and the positions in the longitudinal direction of the multiple calculation points, the rolling mill delivery side material temperature is calculated based upon the various heat generation and heat loss, and similar operations are repeated until the deviation of the rolling mill delivery side temperature from the target temperature is contained within permissible limits.

4 Claims, 3 Drawing Sheets

ROLLED MATERIAL TEMPERATURE CONTROL METHOD AND ROLLED MATERIAL TEMPERATURE CONTROL EQUIPMENT OF DELIVERY SIDE OF ROLLING MILL

BACKGROUND OF THE INVENTION

1. Field of the Invention

The present invention relates to a rolled material temperature control method for the delivery side of a rolling mill and the rolled material temperature control equipment thereof.

2. Description of the Related Art

Hitherto, in order to obtain the material properties of the product, such as tensile strength regarding hot rolling, it has been a requirement that the material temperature at a position on the delivery side of the rolling mill should accurately meet a designated target value over the whole length of the material. To adjust the material temperature at the position on the delivery side, there is a method of controlling the cooling water flow of inter-stand cooling equipment as a coolant and a method of controlling the rolling speed. Normally, these two methods have been used in combination.

Temperature control means for making the material temperature at a position on the delivery side of a rolling mill meet a target value have been disclosed in Laid-Open Patent Gazette No. Heisei 7-75016, Laid-Open Patent Gazette No Heisei 8-150409 and Laid-Open Patent Gazette No. Heisei 10-94814. All of these prior art techniques have compositions that make the temperature on the delivery side of the rolling mill meet the target value by first determining the rolling speed variation pattern, and then, taking this speed variation pattern as a constraint condition, calculating the cooling water flow at each position in the longitudinal direction of the material and controlling the cooling water flow according to the calculated values.

FIG. 2 is a typical rolling mill speed variation pattern. The rolling speed (the roll peripheral velocity of final stand N of the rolling mill) is caused to vary in the three stages of threading speed $V_{N1}$, running speed $V_{N2}$ and tall out speed $V_{N3}$. With the prior art technology, as a general rule, firstly, speeds $V_{N1}$, $V_{N2}$ and $V_{N2}$, are, for example, pre-determined by retrieving the value stored in tables or the like, and then, taking these as constraint conditions, the inter-stand water flows are calculated.

Also, when controlling the above-mentioned cooling water flows and rolling speeds, it is necessary to calculate the appropriate control quantities using a mathematical model (hereafter called 'temperature model') that can accurately simulate the temperature variation behavior of the material in the rolling mill. For this purpose, there is a requirement to consider the following factors in the temperature model.

(a) Processing heat generation accompanying material deformation at each stand (b) Frictional heat generation due to relative slip of the contact surfaces of the material and the rolls (c) Heat loss from the contact surfaces of the material and the rolls (d) Heal loss due to thermal radiation to atmosphere from the material surface between the stands (e) Heat loss to cooling water from the material surface between the stands Examples that take these factors (a)~(e) into consideration in each of the calculations of the above-mentioned threading speed $V_{N1}$, running speed $V_{N2}$ and tail out speed $V_{N3}$ are few. However, that published in Laid-Open Patent Gazette No. Heisei 10-94814 can be considered these factors.

In prior art material temperature control methods such as the above, it is necessary for an operator or an engineer to determine the rolling speed based upon experience. Nowadays it is desirable to increase the rolling speed in order to increase productivity. However, in cases of increasing the rolling speed, there are some cases in which the cooling water flows of the inter-stand cooling means are insufficient due to the constraints of the equipment. In other words, because the set speed value is excessive in relation to the useable cooling water flow, in particular, the cooling water flow being insufficient immediately after acceleration from threading speed to running speed, etc., that part of the rolling mill delivery side temperature relevant to the lengthwise direction of the material will not meet the target value.

Consequently, in order to obtain high productivity while guaranteeing the rolling mill delivery side temperature, it was necessary to determine the most appropriate rolling speed (principally, the above-mentioned running speed $V_{N2}$). This work was mainly done by trial and error on the operator's or engineer's part. For that reason, there were the problems that a great deal of labor was required and that waste of material and energy occurred.

Moreover, in cases where the material temperature at the entry side of the rolling mill or the material thickness at the entry side of the rolling mill changed, it was necessary to re-determine the most appropriate set speed value a second time, and the above-mentioned problems continuously occurred while the operation of the rolling mill continued.

In order to solve such problems, a method can be considered of determining the cooling water flows at a rolling speed variation point, and then calculating the speeds for each section of the speed variation pattern, taking these cooling water flows as constraint conditions. When using this method, the most appropriate rolling speed for a given cooling water flow can easily be determined. Therefore, it becomes possible to make the material temperature at a specified position on the rolling mill delivery side meet the target temperature with good accuracy over the entire length of the material, while guaranteeing high productivity.

However, of the various factors used in the above temperature model, factors (a) and (b) are based upon the deformation resistance of the material, and when the rolling speed is altered, the deformation resistance will change due to the change in the strain rate. Therefore it is necessary to take into consideration the point that these quantities of heat generation will also vary. In other words, in the case of calculating rolling speed taking cooling water flow as a constraint condition, convergence calculation becomes necessary concerning speed.

SUMMARY OF THE INVENTION

Accordingly, one object of the present invention is to provide a novel rolling mill rolled material temperature control method and rolled material temperature control equipment capable of making the material temperature at a specified position on the rolling mill delivery side meet good accuracy with a target value over the entire length of the material, while guaranteeing high productivity, through rendering it possible easily to determine the most appropriate rolling speeds for given cooling water flows by first determining the cooling water flows at rolling speed variation points and then calculating the speeds in the various sections of the speed variation pattern, taking these cooling water flows as constraint conditions, and also enabling the use of a highly accurate temperature model by using a convergence calculation method.

In order to achieve the above object, the present invention is the following method. That is to say, in a rolling mill delivery side rolled material temperature control method that is applied to a rolling mill that provides inter-stand cooling devices that cool the material between multiple rolling stands arranged in tandem, drives each rolling roll of each rolling stand by a motor drive means and, at the same time, regulates the cooling water flows of the inter-stand cooling devices by cooling water flow regulating means, and determines speed setting values for the motor drive means and cooling water flow setting values for the cooling water flow regulation means based upon the material temperature measured further upstream than the rolling mill, the material position detected by sensors on the mill line and transport time information and initial information that includes the pre-determined material steel type, the rolling mill entry side thickness, the product thickness target value and the rolling mill delivery side temperature target value according to the production plan, a rolling mill delivery side rolled material temperature control method that is provided with:

a process that calculates, based upon the said initial information, the material longitudinal direction positions of multiple calculation points on the material that will be the subjects of calculation;

a process that calculates, at each calculation point, the heat generation and heat loss that occur at each rolling stand, based upon the said initial information and the material longitudinal direction positions of the multiple calculation points;

a process that calculates the rolling mill delivery side material temperature, based upon the various heat generation and heat loss; and a process that compares the rolling mill delivery side material temperature and the rolling mill delivery side temperature target value, and, if any deviation is outside the permissible limits, corrects the speed calculated values at each stand, based upon that deviation, and that repeats the processes until the deviation between the rolling mill delivery side material temperature and the rolling mill delivery temperature target value is back within the permissible limits, taking the speed calculated values at specified timings before the various calculation points of the material arrive at the relevant rolling stands as the speed setting values for the motor drive means, and taking the cooling water flows calculated at specified timings before the various calculation points of the material arrive at the rolling stands on the upstream sides of the relevant inter-stand cooling devices as the cooling water flow setting values of the cooling water flow regulation means.

Moreover, in order to achieve the above object, the present invention has the following composition. That is to say, in rolling mill delivery side rolled material temperature control equipment that is applied to a rolling mill that provides inter-stand cooling devices that cool the material between multiple rolling stands arranged in tandem, drives each rolling roll of each rolling stand by a motor drive means and, at the same time regulates the cooling water flows of the inter-stand cooling devices by cooling water flow regulating means, and determines speed setting values for the motor drive means and cooling water flow setting values for the cooling water flow regulation means based upon the material temperature measured further upstream than the rolling mill, the material position detected by sensors on the mill line and transport time information and initial information that includes the pre-determined material steel type, the rolling mill entry side thickness, the product thickness target value and the rolling mill delivery side temperature target value according to the production plan, equipment that Is provided with:

a means that calculates, based upon the initial information, the material longitudinal direction positions of multiple calculation points on the material that will be the subjects of calculation;

a means that calculates, at each calculation point, the heat generation and heat loss that occur at each rolling stand, based upon the initial information and the material longitudinal direction positions of the multiple calculation points;

a means that calculates the rolling mill delivery side material temperature, based upon the various heat generation and heat loss; and a means that compares the rolling mill delivery side material temperature and the rolling mill delivery side temperature target value, and, if any deviation is outside the permissible limits, corrects the speed calculated values at each stand, based upon that deviation, and that repeats the operation of the various means until the deviation between the rolling mill delivery side material temperature and the rolling mill delivery temperature target value is back within the permissible limits, taking the speed calculated values at specified timings before the various calculation points of the material arrive at the relevant rolling stands as the speed setting values for the motor drive means, and taking the cooling water flows calculated at specified timings before the various calculation points of the material arrive at the rolling stands on the upstream sides of the relevant inter-stand cooling devices as the cooling water flow setting values of the cooling water flow regulation means.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
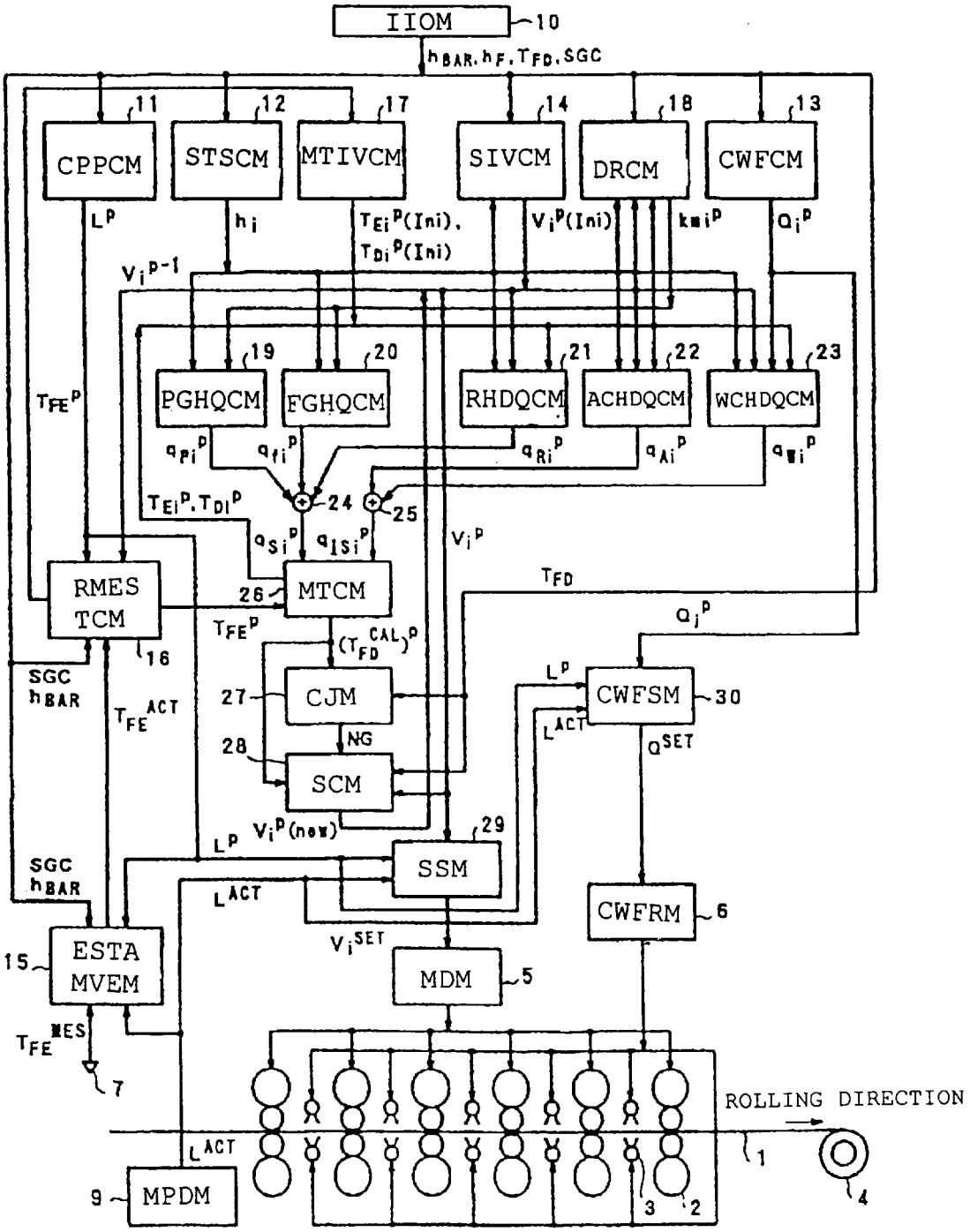
FIG. 1 is a block diagram showing an embodiment of rolling mill material temperature control equipment that implements the rolling mill delivery side rolled material temperature control method concerned in the present invention.

Referring now to the drawings, wherein like reference numerals designate identical or corresponding parts throughout the several views, and more particularly to FIG. 1 thereof, one embodiment of the present invention will be described.

FIG. 1 is a block diagram showing an embodiment of rolling mill material temperature control equipment that implements the rolling mill delivery side rolled material temperature control method concerned in the present invention. In this drawing, material (strip) 1 is rolled in a rolling mill comprising six rolling stands 2 (stand numbers i=1~6), and is coiled by coiler 4 placed on the downstream side this rolling mill. Motor drive means 5 is provided that supplies driving power to the unillustrated motors that drive the rolls of each of these rolling stands, and also performs fine adjustment of the speed of each stand so that the proper tension acts in the material between stands.

Also, inter-stand cooling devices 3 that respectively spray cooling water on the rolled material are provided between the stands. Cooling water flow regulation means 6 is designed to operate the degree of opening of the flow regulator valves of these inter-stand cooling devices 3. Moreover, rolling mill entry side thermometer 7 is provided to detect the material temperature on the entry side of the rolling mill. This thermometer is installed so that it measures the material temperature of the central part in the strip width direction, and detects the surface temperature of the material. Also, material position detection means (MPDM) 9 is provided above the mill line, and sequentially computes material position $L^{ACT}$, based upon material detection signals, from unillustrated material sensors that are installed above the mill line, and transport time information.

At the same time, initial information output means (IIOM) 10 is provided to output the Steel Grade Code SGC, rolling mill entry side material thickness $h_{BAR}$, product strip thickness target value $h_F$ and rolling mill delivery side temperature target value $T_{FD}$ of material 1, based upon the pre-determined production plan. The design of the composition is that, on the basis of this initial information, calculation point position calculation means (CPPPCM) 11, at a specified timing before material 1 reaches the rolling mill, calculates the positions $L^P$ of multiple calculation points p in the material longitudinal direction that will become the subjects of speed calculation; strip thickness schedule calculation means (STSCM) 12 calculates the delivery side strip thickness $h_1$ or each stand; cooling water flow calculation means (CWFCM) 13 calculates the cooling water flow $Q_A{}^P$ used in each inter-stand cooling device 3, and speed initial value calculation means (SIVCM) 14 calculates the speed reference value $V_1{}^P$(Ini) to be taken as the initial value for convergence calculation, respectively.

Also, entry side temperature actual measured value extraction means (ESTAMVEM) 15 is provided that monitors actual material position $L^{ACT}$ by information of material position detection means 9, finds the mean temperature in the strip thickness direction of material position $L^P$ based upon measured surface temperature $T_{FE}{}^{MES}$ by rolling mill entry side thermometer 7, Steel Grade Code SGC and rolling mill entry side material thickness $h_{BAR}$ outputted from initial information output means 10 and detected position $L^P$ from calculation point position calculation means 11, and outputs this as calculation point material average temperature actual value $T_{FE}{}^{ACT}$. moreover, rolling mill entry side temperature calculation means (RMESTCM) 16 is provided that calculates material temperature $T_{FE}{}^P$ when each calculation point of material 1 arrives at a specified position on the rolling mill delivery side, for example immediately below rolling mill delivery side thermometer 7, based upon calculation point material temperature actual value $T_{FE}{}^{ACT}$ outputted from entry side temperature actual measured value extraction means 15, Steel Grade Code SGC and rolling mill entry side material thickness $h_{BAR}$ outputted from initial information output means 10, detected position $L^P$ from calculation point position calculation means 11 and speed reference value $V_1{}^P$ of speed initial value calculation means 14 or speed corrected value $V_1{}^P$(new) of the under-mentioned speed correction means 28.

Material temperature initial value calculation means (MTIVCM) 17 is provided that outputs the entry side temperatures $T_{Ex}{}^P$ for each stand and the delivery side temperatures $T_{D1}{}^P$ for each stand, which are used as the convergence calculation initial values, based upon material temperature $T_{FE}{}^P$ calculated by rolling mill entry side temperature calculation means 16 and rolling mill delivery side temperature target value $T_{FD}$ outputted from initial information output means 10. Deformation resistance calculation means (DRCM) 18 is provided that calculates deformation resistance $k_{mi}{}^P$ based upon output $h_1$ of strip thickness schedule calculation means 12, Steel Grade Code SGC, rolling mill entry side material thickness $h_{BAR}$, product strip thickness target value $h_F$ and rolling mill delivery side temperature target value $T_{FD}$ outputted from initial information output means 10 and speed reference value $V_1{}^P$ of speed initial value calculation means 14 or speed corrected value $V_1{}^P$(new) of speed correction means 28.

Also, the design is that process-generated heat quantity calculation means (PGHQCM) 19 computes the process-generated heat quantities $q_{p1}{}^P$ that accompany material deformation in each stand and friction-generated heat quantity calculation means (FGHQCM) 20 computes the friction-generated heat quantities $q_{p1}{}^P$ due to relative slippage of the contact surfaces of the material and the rolls, each using output $h_1$ of strip thickness schedule calculation means 12 and output $k_{m1}{}^P$ of deformation resistance calculation means 18. $h_1$ means i-th stand delivery thickness and $k_{m1}{}^P$ means i-th stand deformation resistance predicted value of calculation point P. Also, roll heat loss quantity calculation means (RMDQCM) 21 calculates heat loss quantities $q_{R1}{}^P$ due to heat transfer between the contact surfaces of the material and the rolls, air-cooling hear loss quantity calculation means (ACHDQCM) 22 calculates heat loss quantities $q_{A1}{}^P$ due to heat radiation to atmosphere from the material surface between the various stands and water-cooling heat loss quantity calculation means (WCHDQCM) 23 calculates heat loss quantities $q_{W1}{}^P$ from the material surfaces to the cooling water between the various stands, each on the basis of output side strip thickness $h_1$ computed for each stand by strip thickness schedule calculation means 12, speed reference value $V_1{}^P$ of speed initial value calculation means 14 or speed corrected value $V_1{}^P$(new) of speed correction means (SCM) 29, and material temperature $T_{Ex}{}^P$ of calculation point p at the entry side of each stand and material temperature $T_{D1}{}^P$ of calculation point p at the delivery side of each stand that are outputted from the under-mentioned material temperature calculation means (MTCM) 26.

The composition is designed so that, of these, process-generated heat quantity $q_{p1}{}^P$, friction-generated heat quantity $q_{f1}{}^P$ and heat loss quantity $q_{R1}{}^P$ are applied to addition means 24, and heat sum $q_{S1}{}^P$ in the roll bite is found here. Moreover, heat loss quantity $q_{A1}{}^P$ due to heat radiation to atmosphere and heat loss quantity $q_{W1}{}^P$ to the cooling water are applied to addition means 25, and total heat balance $q_{IS1}{}^P$ between stands is found. These heat sums are applied to material temperature calculation means 26. Material temperature calculation means 26, based upon these heat sums $q_{S1}{}^P$ and $q_{IS1}{}^P$ and material temperature $T_{FE}{}^P$ outputted from rolling mill entry side temperature calculation means 16, computes material temperatures $T_{E1}{}^P$ for calculation points p at the entry side of each stand, material temperatures $T_{D1}{}^P$ for calculation points p at the delivery side of each stand and material temperature calculated values $(T_{FD}{}^{CAL})^P$ for the times at which calculation points p arrive at a specified point on the rolling mill delivery side. Material temperatures $T_{E1}^{P}$ and $T_{D1}^{P}$ are applied to roll heat loss quantity calculation means 21 and air-cooling heat loss quantity calculation means 22, and material temperature calculated values $(T_{FD}^{CAL})^{P}$ are applied to convergence judgment means (CJM) 27 and speed correction means 28.

Convergence judgment means 27 compares calculated values $(T_{FD}^{CAL})^{P}$ of material temperature calculation means 26 with rolling mill delivery side temperature target value $T_{FD}$, and when any deviation exceeds the permissible limits it outputs 'correction required' signal NG. When this 'correction required' signal NG is outputted from convergence judgment means 27, speed correction means 28 computes correction value $V_1^{P}$(new) for the temperature calculated value, based upon rolling mill delivery side temperature target value $T_{FD}$ outputted from initial information output means 10, speed reference value $V_1^{P}$ outputted from speed initial value calculation means 14 and material temperature calculated value $(T_{FD}^{CAL})^{P}$ outputted from material temperature calculation means 26.

Also, speed setting means (SSM) 29 is provided that applies speed setting values $V_1^{SET}$ for each stand to motor drive means 5, based upon material positions $L^{ACT}$ detected by material position detection means 9, detection position $L^{P}$ calculated by calculation point position calculation means 11 and speed reference value $V_1^{P}$ of speed initial value calculation means 14 or speed correction value $V_1^{P}$(new) of speed correction means 28. Moreover, cooling water flow setting means (CWFSM) 30 is provided that applies cooling water flow setting values $Q_1^{SET}$ to cooling water flow regulation means 6, based upon material positions $L^{ACT}$ detected by material position detection means 9, detection positions $L^{P}$ calculated by calculation point position calculation means 11 and cooling water flows $Q_1^{P}$ calculated by cooling water flow calculation means 13.

The following is a detailed description of the operation of the rolling mill delivery side rolled material temperature control equipment composed as stated above.

First, material 1 is heated by an upstream process and, after being made a thickness of approximately 20–50 mm, arrives at the rolling mill. This material 1 is rolled in a rolling mill comprised of six rolling stands 2 arranged in tandem and is coiled by coiler 4 installed on its downstream side. During rolling, it it cooled by inter-stand cooling devices 3 provided between the various stands. At this time, motor drive means 5 regulates the speeds of the motors that drive the rolls of each stand in accordance with speed setting values $V_1^{SET}$ that are provided and, moreover, performs fine adjustment of the speeds of each stand so that the tension acting in the material between stands will be correct. Also, cooling water flow regulation means 6 controls the degree of opening of the flow regulation valves of inter-stand cooling devices 3 in accordance with cooling water flow setting values $Q_1^{SET}$ that are provided, and regulates the flows of cooling water sprayed on the material between the various stands.

Rolling mill entry side thermometer 7 is composed of a radiation thermometer, and measures the material surface temperature of the central part in the strip width direction at the entry side of the rolling mill, outputting measured temperature $T_{FE}^{MES}$. Also, material position detection means 9 sequentially calculates and outputs material 1 positions $L^{ACT}$ on the mill line, based upon sensors installed above the mill line and transport time information.

Figure 2:
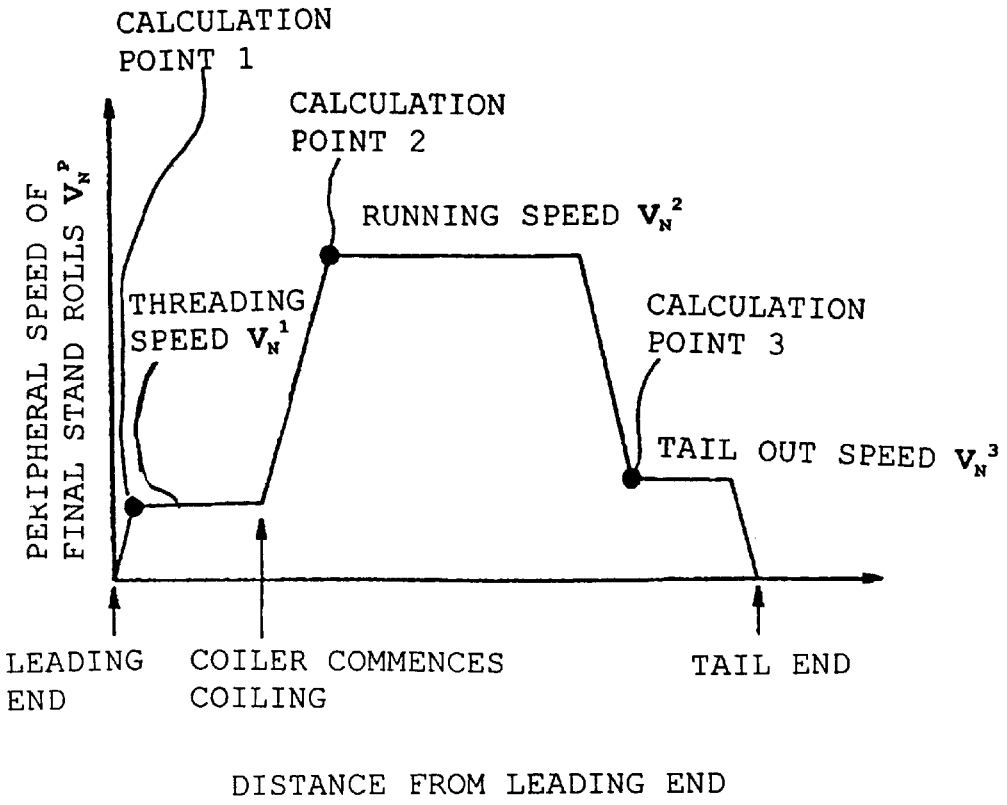
FIG. 2 is a graph showing the relationship between the distance from the leading end of the rolled material and the roll speed of the final stand in order to illustrate the operation of the rolled material temperature control equipment shown in FIG. 1.

Initial information output means 10 outputs Steel Grade Code SGC, rolling mill entry side material thickness $h_{BAR}$, product strip thickness target value $h_F$ and rolling mill delivery side temperature target value $T_{FD}$ of material 1. Calculation point position calculation means 11, at a specified timing before material 1 arrives at the rolling mill, calculates and sequentially outputs positions $L^{P}$ (p: calculation point position) in the material longitudinal direction of multiple calculation points p on the material that become the subjects of speed calculation, based upon the output signals of initial information output means 10. For the numbers of calculation points p, the calculation point on the very leading end side on the material is taken as "1", and thereafter numbers are allocated in sequence from that given to the leading end. In the present embodiment, as shown in FIG. 2, there are three calculation points "1", "2" and "3", corresponding to the speed variation points.

Strip thickness schedule calculation means 12 calculates delivery side strip thickness $h_1$ for each stand, based upon the output information of initial information output means 10. There are various methods for this calculation. For example, there are such methods as retrieve from a table in which standard strip width schedules are pre-stored, using rolling mill entry side material thickness $h_{BAR}$, product strip thickness target value $h_F$ and rolling mill delivery side temperature target value $T_{FD}$ as keys.

Cooling water flow calculation means 13 calculates and outputs cooling water flow rate $Q_1^{P}$ used in each inter-stand cooling device 3, based upon the output information of initial information output means 10. Here, a method is used that refers to a table, taking rolling mill entry side material thickness $h_{BAR}$, product strip thickness target value $h_F$ and rolling mill delivery side temperature target value $T_{FD}$ as keys.

It is general practice to make threading speed $V_6^{1}$ of the sixth stand in relation to calculation point "1" of material 1 and threading speed $V_6^{3}$ of the sixth stand in relation to calculation point "3" of material 1 comparatively small values from the condition of correct threading of the leading end of material 1 by each stand of the rolling mill and the viewpoint of prevention of unstable behaviour when the tail out deliverys. For this reason, cooling water flow $Q_1^{1}$ for the leading end part and cooling water flow $Q_1^{3}$ for the tail out part are determined taking these facts into consideration. A value close to maximum flow is taken for cooling water flow $Q_1^{2}$ for the steady part.

Since it is taken as the initial value for convergence calculation, speed initial value calculation means 14 outputs speed reference value $V_1^{P}$(Ini), based upon the output information of initial information output means 10. In the present embodiment a method is used that refers to a table, taking rolling mill entry side material thickness $h_{BAR}$, product strip thickness target value $h_F$ and rolling mill delivery side temperature target value $T_{FD}$ as keys.

Entry side temperature actual measured value extraction means 15 monitors material detected positions $L^{ACT}$ of material position detection means 9, and extracts measured value $T_{FE}^{MES}$ of the material surface temperature when a position in the vicinity of the material leading end arrives directly below rolling mill entry side thermometer 7. Then it converts this to the mean temperature in the strip thickness direction, based upon the information on rolling mill entry side material thickness $h_{BAR}$ and Steel Grade Code SGC outputted from initial information output means 10, and outputs this as calculation point material temperature actual measured value $T_{FE}^{ACT}$. The conversion from surface temperature to mean temperature uses, for example, a simple expression, such as a first degree expression, that takes rolling mill entry side material thickness $h_{BAR}$ as a variable and applies a correction according to the steel grade. With this embodiment, entry side temperature actual measured value extraction means 15 only extracts the actual measured value in the leading end part of the material. However, actual measured values may also be extracted in multiple position.

Rolling mill entry side temperature calculation means 16 calculates material temperatures $T_{FE}^{P}$ when each calculation point arrives at a specified position on the rolling mill entry side (the position directly below rolling mill entry side thermometer 7 is taken in this embodiment). Calculation point material temperature actual measured value $T_{FE}^{ACT}$ of entry side temperature actual measured value extraction means 15, information on rolling mill entry side material thickness $h_{BAR}$ steel Grade Code SGC outputted from initial information output means 10, position $L^P$ of calculation point p in the material longitudinal direction outputted from calculation point position detection means 11 and speed reference value $V_1^P$ outputted from speed initial value calculation means 14 or speed corrected value $V_1^P$(new) outputted from speed correction means 28 are used in this calculation. For example, material temperature $T_{FE}^{P}$ is calculated by the following expression.

$$T_{FE}^{P}=T_{FE}^{P-1}-f_{FE}(\zeta)\ \zeta=\epsilon_A,\ \sigma,\ \rho,\ \phi,\ h_{BAR},\ T_{FE}^{P-1},\ T_A,\ t_{FE}^{P} \quad (1)$$

$$t_{FE}^{P}=f_{DLx}(V_1^{P-1},\ t_{FE}^{P-1},\ L^{P-1},\ L^{P}) \quad (2)$$

where, $f_{FE}(\zeta)$: Function expressing temperature drop due to thermal radiation $\epsilon_A$: Emissivity (table value using Steel Grade Code SGC as key)

$\sigma$: Stefan-Boltzmann constant $\rho$: Material density $\phi$: Specific heat of material $T_A$: Atmospheric temperature Here, $t_{FE}^{P}$ is the calculated value of the time taken for calculation point p, which is taken as the subject, to arrive at rolling stand i after adjacent calculation point (p−1) has arrived at the installation position of rolling mill entry side thermometer 7.

When calculating material temperature $T_{FE}^{P}$, the actual measured temperature by a thermometer installed in a different position further upstream than the rolling mill, such as a rough rolling mill delivery side thermometer, or the healing target temperature of a heating furnace may also be used.

Material temperature initial value calculation means 17, based upon rolling mill delivery side target temperature $T_{FD}$ outputted from initial information output means 10 and detected temperatures $T_{FE}^{P}$ of rolling mill entry side temperature calculation means 16, computes and outputs the entry side temperatures $T_{E1}^{P}$(Ini) for each stand and delivery side temperatures $T_{D1}^{P}$(Ini) for each stand that are used as the initial values for convergence calculation. In this embodiment $T_{E1}^{P}$(Ini) and $T_{D1}^{P}$(Ini) are outputted as linearly interpolated values.

Deformation resistance calculation means 18 calculates and outputs mean deformation resistance $k_{D1}^{P}$ in the case of deformation being applied to the material by relevant stands, using Expression (3). In this calculation, delivery side strip thicknesses $h_1$ for each stand calculated by strip thickness schedule calculation means 12, Steel Grade Code SGC information outputted from initial information output means 10, speed calculated value $V_1^P$ outputted from speed initial value calculation means 14 or speed calculated value $V_1^P$ (new) outputted from speed correction means 29, and entry side temperatures $T_{E1}^{P}$ for each stand outputted from material temperature initial value calculation means 17 or material temperature calculation means 26 are used.

$$K_{m1}^{P}=f_{hm}(h_{l-1},\ h_1,\ V_1^P,\ T_{e1}^P,\ SGC) \quad (3)$$

Process-generated heat quantity calculation means 19 calculates process-generated heat quantities $q_{P1}^{P}$ that accompany deformation of the material in each stand; friction-generated heat quantity calculation means 20 calculates friction-generated heat quantities $q_{f1}^{P}$ due to relative slippage between the contact surfaces of the material and the rolls; roll heat loss quantity calculation means 21 calculates heal loss quantities $q_{R1}^{P}$ due to heat transfer between the surfaces of the material and the rolls; air-cooling heat loss quantity calculation means 22 calculates heat loss quantities $q_{A1}^{P}$ due heat radiation to atmosphere from the material surface between the various stands and water-cooling heat loss quantity calculation means 23 calculates heat loss quantities $q_{W1}^{P}$ to the cooling water from the material surface between the various stands, respectively.

In these calculations, delivery side strip thicknesses $h_1$ for each stand calculated by strip thickness schedule calculation means 12, rolling mill delivery side temperature target value $T_{FD}$ and Steel Grade Code SGC information outputted from initial information output means 10, speed calculated values $V_1^P$ outputted from speed initial value calculation means 14 or speed correction means 28, entry side temperatures $T_{E1}^{P}$ for each stand outputted from material temperature initial value calculation means 17 or material temperature calculation means 26, mean deformation resistances $k_{m1}^{P}$ outputted from deformation resistance calculation means 18 and heat loss quantities $q_1^P$ outputted from cooling water flow calculation means 13 are used. The calculation expressions given below are examples of those used in this embodiment. Here, process-generated heat quantity $q_{P1}^{P}$, friction-generated heat quantity $q_{f1}^{P}$, heat loss quantity $q_{R1}^{P}$ due to heat transfer to rolls, heat loss quantity $q_{A1}^{P}$ to atmosphere and heat loss quantity $q_{W1}^{P}$ to cooling water are all heat quantities per unit time and per unit strip width.

Process-generated heat quantity calculation means 19 calculates process-generated heat quantities $q_{p1}^{P}$ using the following expression.

$$q_{p1}^{P}=f_p(k_{m1}^{P},\ V_1^P,\ h_{l-1},\ h_1) \quad (4)$$

Friction-generated heat quantity calculation means 20 calculates friction-generated heat quantities $q_{f1}^{P}$ using the following expression.

$$q_{f1}^{P}=f_f(\mu,\ k_{m1}^{P},\ h_{l-1},\ h_1) \quad (5)$$

Roll heat loss quantity calculation means 21 calculates heat loss quantities $q_{R1}^{P}$ to the rolls using the following expression.

$$q_{R1}^{P}=f_R(V_1^P,\ T_{E1}^P,\ T_{R1},\ h_{l-1},\ h_1,\ \rho,\ \phi,\ \lambda,\ \rho_R,\ \phi_R,\ \lambda_R) \quad (6)$$

Air-cooling heat loss quantity calculation means 22 calculates heat loss quantities $q_{A1}^{P}$ to atmosphere using the following expression.

$$q_{A1}^{P}=f_A(L_{IS1},\ T_{D1}^P,\ T_A,\ \epsilon_A,\ \sigma) \quad (7)$$

Water-cooling heat loss quantity calculation means 22 calculates heat loss quantities $q_{W1}^{P}$ to the cooling water using the following expression.

$$q_{W1}^{P}=f_W(L_{IS1},\ T_{D1}^P,\ T_{R1},\ Q_1^P) \quad (8)$$

Here, $f_p(\ldots)$: Function expressing process-generated heat quantity $f_r(\ldots)$: Function expressing friction-generated heat quantity $f_D(\ldots)$: Function expressing heat loss quantity to rolls $f_A(\ldots)$: Function expressing heat loss quantity due to air cooling $f_W(\ldots)$: Function expressing heat loss quantity due to water cooling $\mu$: Coefficient of friction $\rho$: Density of rolled material $\phi$: Specific heat of rolled material $\lambda$: Coefficient of thermal conductivity of rolled material $\rho_R$: Density of roll $\phi_R$: Specific heat of roll $\lambda_R$: Coefficient of thermal conductivity of roll $\epsilon_A$: Emissivity to atmosphere o: Stefan-Boltzmann constant $L_{IS1}$: Distances between i stand and i+1 stand $T_A$: Atmospheric temperature $T_{R2}$: Representative roll temperature Addition means 24 and addition means 25 add the heat balances in the bites of each roll and between the stands. Of these, addition means 24 calculates and outputs sum $q_{S1}{}^P$ of the outputs of process-generated heat quantity calculation means 19, friction-generated heat quantity calculation means 20 and roll heat loss quantity calculation means 21. Addition means 25 calculates and outputs sum $q_{IS1}{}^P$ of the outputs of air-cooling hear loss quantity calculation means 22 and water-cooling heat loss quantity calculation means 23

Material temperature calculation means 26 outputs material temperature $T_{E1}{}^P$ of calculation point p at the entry side of each stand, material temperature $T_{D1}{}^P$ of calculation point p at the delivery side of each stand and calculated value $(T_{FD}{}^{CAL})^P$ of the material temperature at the time when calculation point p arrives at a specified position on the rolling mill delivery side. The following expressions are used in these calculations.

$$T_{E1}^{\rho} = f_{TE1}(T_{FE}^{\rho}, T_A, V_1^{\rho}, h_{BAR}, h_1, L_{F1}, \varepsilon_A, \sigma, \rho, \phi) \tag{9}$$

$$T_{D1}^{p} = f_{TD}(V_1^p, T_{\varepsilon 1}^p, q_1^p, \rho, \phi, h_{i-1}, h_1) \tag{10}$$

$$T_{Ei-1}^{\rho} = f_{TE}(q_{ISi}^p, \rho, \phi, h_{i-1}, h_1, v_i^p) \tag{11}$$

$$(T_{FD}^{CAL})^{\rho} = f_{TFD}(T_{D6}^p, V_6^{\rho}, h_6, T_A, L_{FD}, \varepsilon_A, \sigma, \rho, \phi) \tag{12}$$

Here, $L_{F1}$ is the distance from rolling mill entry side thermometer 7 to the first stand of the rolling mill. Also, $L_{FD}$ is the distance from the last stand of the rolling mill to a specified point on the delivery side of the rolling mill (the installation position of the unillustrated delivery side thermometer).

Convergence judgment means 27 compares output $(T_{FD}{}^{CAL})^P$ of material temperature calculating means 26 with rolling mill delivery side temperature target value $T_{FD}$ outputted from initial information output means 10 and, if it in outside the permissible limits, outputs 'correction required' signal NG. The following expression is used in this judgement.

$$|(T_{FD}{}^{CAL})^P - T_{FD}| \leqq \delta_{min} \tag{13}$$

Here, $\delta_{min}$ is a minute value.

Then, speed correction means 28, when it receives a 'correction required' signal NG from convergence judgement means 27, calculates and outputs corrected value $V_1{}^P$(new) for the calculated value, using the following expressions.

$$V_6^p(new) = V_6^p(old) - \frac{\partial V_6^p}{\partial T_{FD}}\{(T_{FD}^{CAL})^P - T_{FD}\} \tag{14}$$

$$\frac{V_1(new)}{h_2} = \frac{V_6(new)}{h_6} \quad (i = 1 \sim 5) \tag{15}$$

here, $V_1{}^P$(old): Speed calculated value $V_1{}^P$ before correction $\frac{\partial V_6^p}{\partial T_{FD}}$: Partial differential coefficient Incidentally, partial differential coefficient $$\frac{\partial V_6^p}{\partial T_{FD}}$$

is calculated by the following expression, using the calculation result for $(T_{FD}{}^{CAL})^P$ in the case of the addition of minute value ($\pm\delta_v$) to $V_6{}^P$(old).

$$\frac{\partial V_6^p}{\partial T_{FD}} = \frac{1}{\dfrac{T_{FD}^{CAL}(V_6^p + \delta_v) - T_{FD}^{CAL}(V_6^p - \delta_v)}{2 \cdot \delta_v}} \tag{16}$$

here, $\delta_v$ is a minute value.

When corrected value $V_1{}^P$(new) for the speed calculated value is outputted from speed correction means 28, recalculation is performed in rolling mill entry side temperature calculation means 16, roll heat loss quantity calculation means 21, air-cooling heat loss quantity calculation means 22 and water-cooling heat loss quantity calculation means 23, and the outputs of each are renewed.

Incidentally, in Expression (13), in a case in which the solution is judged to have converged, convergence judgement means 27 does not output 'correction required' signal NG. Therefore renewal of speed calculated value $V_1{}^P$ is not performed.

All the above calculations are normally completed before material 1 arrives at the first stand of the rolling mill. Thereafter, rolling speed $v_1{}^P$ varies in the following manner. First, when material 1 approaches the first stand of the rolling mill, speed setting means 29 outputs speed calculated value $V_1{}^1$ of the first calculation point (p=1) to motor drive means 5 at a specified timing. After that, each time the second and third calculation points (p=2, 3) on material 1 arrive at a specified position within the rolling mill, speed setting means 29 outputs speed calculated value $V_1{}^P$ the relevant calculation point to motor drive means 5.

Also, cooling water flow $Q_1{}^P$ varies in the following manner. First, when material 1 approaches the first stand of the rolling mill, cooling water flow setting means 30 outputs cooling water flow $Q_1{}^1$ of the first calculation point (p=1) to cooling water flow regulation means 6 at a specified timing.

After that, each time the second and third calculation points (p=2, 3) on material 1 arrive at a specified position within the rolling mill, cooling water flow setting means 30 sequentially outputs cooling water flow $Q_1^P$ for the relevant calculation point to cooling water flow regulation means 6.

Figure 3:
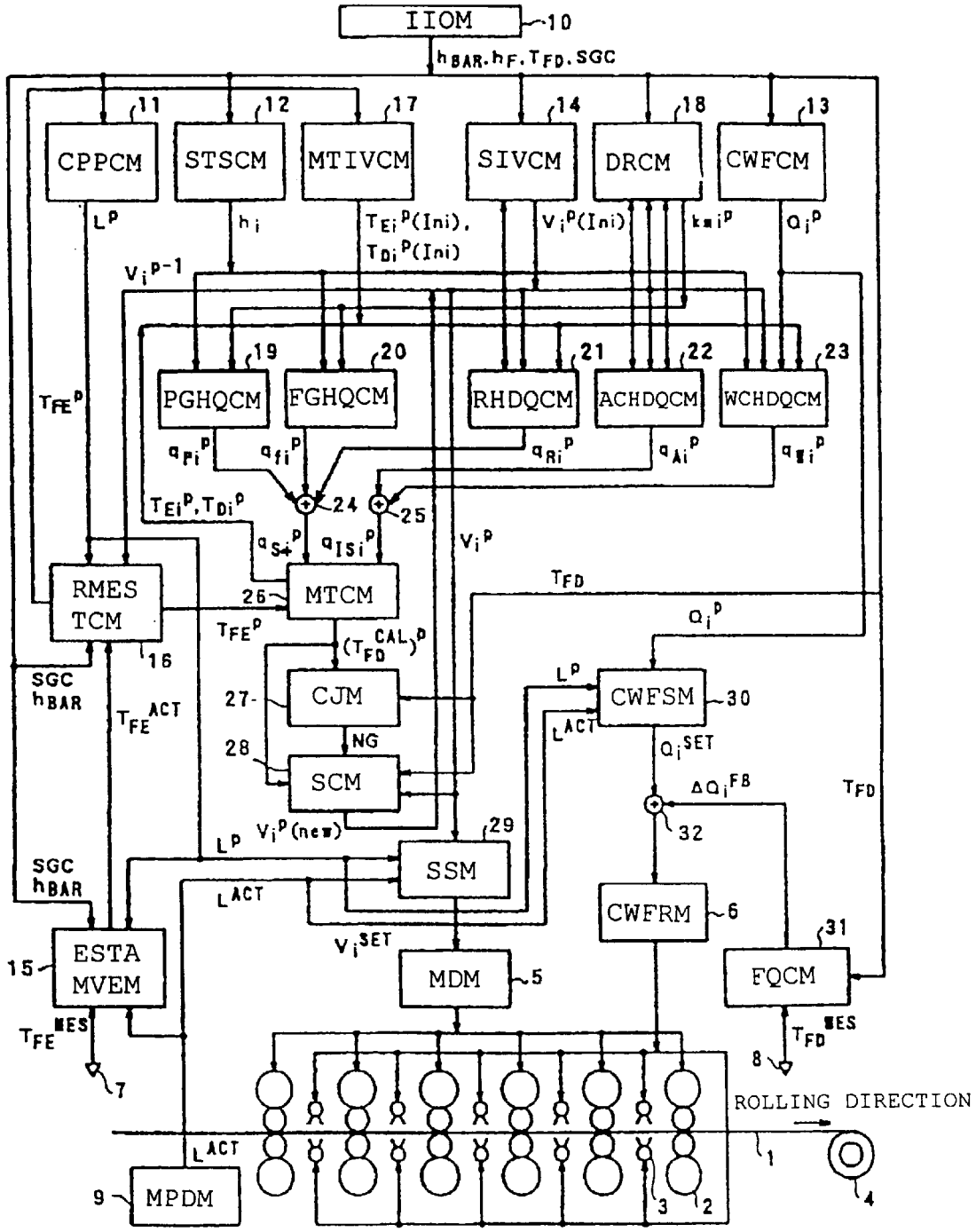
FIG. 3 is a block diagram showing another embodiment of rolled material temperature control equipment that implements the rolling mill delivery side rolled material temperature control method concerned in the present invention.

FIG. 3 is a block diagram showing another embodiment of rolling mill delivery side rolled material temperature control equipment that implements the rolling mill rolled material temperature control method concerned in the present invention. Those elements in the drawing that are identical to FIG. 1 have been allocated like reference numerals and their descriptions have been omitted. Here, rolling mill delivery side thermometer 8, of a similar composition to rolling mill entry side thermometer 7, is provided on the delivery side of the rolling mill. Moreover, feedback quantity calculation means (FQCM) 31 and addition means 32, which are also newly provided, input actual measured temperature $T_{FD}^{MES}$ from rolling mill delivery side thermometer 8 and rolling mill delivery side temperature target value $T_{FD}$ outputted from initial information output means 10 and, according to any deviation, correct cooling water flow setting value $Q_1^{SET}$ that is applied to cooling water flow regulation means 6. That is to say, feedback quantity calculation means 31 compares actual measured temperature $T_{FD}^{MES}$ and rolling mill delivery side temperature target value $T_{FD}$ that is applied as initial information, and outputs cooling water flow correction value$\Delta Q_{FB1}$ to make any deviation approach zero. Addition means 32 adds cooling water flow correction value$\Delta Q_{FB1}$ to cooling water flow setting value $Q_1^{SET}$ outputted from cooling water flow setting means 30, and thus corrects the cooling water flow setting value $Q_1^{SET}$ that is supplied to cooling water flow regulation means 6.

The present invention has been described above using rolled material temperature control equipment that takes a tandem mill as its subject for application. However, the applications of the present invention are not limited to this, and it can also be applied to rolling mills configured for multi-pass reversal rolling through the same stand by viewing each pass as through a tandem stand.

As is apparent from the above description, when using the present invention, by first determining the cooling water flows at the rolling mill speed variation points, then simply determining the most appropriate rolling speed as a constraint condition for these cooling water flows, and also by making possible the use of a highly accurate temperature model using a convergence calculation method, it is possible to make the material temperature at a specified position on the delivery side of a rolling mill meet a target value with good accuracy over the entire length of the material, while guaranteeing high productivity.

Obviously, numerous additional modifications and variations of the present invention are possible in light of the above teachings it is therefore to be understood that within the scope of the appended claims, the present invention may be practised otherwise than as specially described herein.

What is claimed is:

1. In a rolling mill delivery side rolled material temperature control method that is applied to a rolling mill that provides inter-stand cooling devices that cool the material between multiple rolling stands arranged in tandem, drives each rolling roll of each of said rolling stands by a motor drive means and, at the same time, regulates the cooling water flows of said inter-stand cooling devices by cooling water flow regulating means, and determines speed setting values for said motor drive means and cooling water flow setting values for said cooling water flow regulation means based upon the material temperature measured further upstream than said rolling mill, the material position detected by sensors on the mill line and transport time information and any initial information that includes the pre-determined material steel type according to the production plan, the rolling mill entry side thickness, a product thickness target value and a rolling mill delivery side temperature target value, said rolling mill delivery side rolled material temperature control method comprising the steps of:

first calculating material longitudinal direction positions of multiple calculation points on the material that will be the subjects of calculation based upon said initial information;

second calculating, at each said calculation point, heat generation and heat loss that occur at each of said rolling stands, based upon said initial information and material longitudinal direction positions of said multiple calculation points;

third calculating a rolling mill delivery side material temperature, based upon said heat generation and heat loss; and comparing said rolling mill delivery side material temperature with said rolling mill delivery side temperature target value, and, if any deviation is outside permissible limits, correcting speed calculated values at each of said rolling stands, based upon said deviation, wherein said rolling mill delivery side rolled material temperature control method repeats each of the above processes until said deviation between said rolling mill delivery side material temperature and said rolling mill delivery temperature target value is back within the permissible limits, taking the speed calculated values at specified timings, before various ones of said calculation points of the material arrive at relevant ones of said rolling stands, as the speed setting values for said motor drive means, and taking said cooling water flows calculated at specified timings before said calculation points of the material arrive at said rolling stands on the upstream sides of the relevant ones of said inter-stand cooling devices as cooling water flow setting values of said cooling water flow regulation means.

2. The rolling mill delivery side rolled material temperature control method according to claim 1, further comprising:

measuring said rolling mill delivery side material temperature, comparing said rolling mill delivery side material temperature with said rolling mill delivery side temperature target value, calculating a cooling water flow correction quantity that will make any deviation approach zero, and correcting said cooling water flow setting value of said cooling water flow regulation means by said cooling water flow correction quantity.

3. In a rolling mill delivery side rolled material temperature control equipment that is applied to a rolling mill that provides inter-stand cooling devices that cool the material between multiple rolling stands arranged in tandem, drives each rolling roll of each of said rolling stands by a motor drive means and, at the same time, regulates the cooling water flows of said inter-stand cooling devices by a cooling water flow regulating means, and determines speed setting values for said motor drive means and cooling water flow setting values for said cooling water flow regulation means based upon a material temperature measured further upstream than said rolling mill, a material position detected by sensors on the mill line and transport time information and any initial information that includes the pre-determined material steel type according to the production plan, a rolling mill entry side thickness, a product thickness target value and a rolling mill delivery side temperature target value, said rolling mill delivery side rolled material temperature control equipment comprising:

a first means for calculating material longitudinal direction positions of multiple calculation points on the material that will be the subjects of calculation based upon said initial information;

a second means for calculating, at each said calculation point, heat generation and heat loss that occur at each of said rolling stands, based upon said initial information and said material longitudinal direction positions of the multiple calculation points;

a third means for calculating a rolling mill delivery side material temperature, based upon said heat generation and heat loss; and a means for comparing said rolling mill delivery side material temperature with said rolling mill delivery side temperature target value, and, if any deviation is outside permissible limits, for correcting speed calculated values at each of said rolling stands, based upon said deviation, wherein said rolling mill delivery side rolled material temperature control equipment repeats an operation until said deviation between said rolling mill delivery side material temperature and said rolling mill delivery temperature target value is back within the permissible limits, taking said speed calculated values at specified timings, before said calculation points of the material arrive at relevant ones of said rolling stands, as speed setting values for motor drive means, and taking said cooling water flows calculated at specified timings before said calculation points of the material arrive at said rolling stands on the upstream sides of the relevant ones of said inter-stand cooling devices as the cooling water flow setting values of said cooling water flow regulation means.

4. The rolling mill delivery side rolled material temperature control equipment according to claim 3, further comprising:

a rolling mill delivery side thermometer that measures the material temperature on said rolling mill delivery side;

a feedback quantity calculation means that compares said rolling mill delivery side material temperature measured by said rolling mill delivery side thermometer with said rolling mill delivery side temperature target value, and calculates a cooling water flow correction quantity that will make any deviation approach zero; and an addition means that corrects the cooling water flow setting value of said cooling water flow regulation means by the cooling water flow correction quantity calculated by said feedback quantity calculation means.

* * * * *